US007121646B2

(12) United States Patent
Bibl et al.

(10) Patent No.: US 7,121,646 B2
(45) Date of Patent: Oct. 17, 2006

(54) DROP EJECTION ASSEMBLY

(75) Inventors: Andreas Bibl, Los Altos, CA (US); Paul A. Hoisington, Norwich, VT (US); John C. Batterton, Santa Clara, CA (US); Melvin L. Biggs, Norwich, VT (US)

(73) Assignee: Dimatix, Inc., Lebanon, NH (US)

( * ) Notice: Subject to any disclaimer, the term of this patent is extended or adjusted under 35 U.S.C. 154(b) by 252 days.

(21) Appl. No.: 10/749,816

(22) Filed: Dec. 30, 2003

(65) Prior Publication Data

US 2005/0146561 A1 Jul. 7, 2005

(51) Int. Cl.
*B41J 2/14* (2006.01)

(52) U.S. Cl. ..... 347/47

(58) Field of Classification Search ..... 347/20, 347/44, 47, 54–56, 68, 71, 85; 216/27; 29/890.1
See application file for complete search history.

(56) References Cited

U.S. PATENT DOCUMENTS

| | | | | |
|---|---|---|---|---|
| 3,747,120 | A | 7/1973 | Stemme | 347/20 |
| 4,613,875 | A | 9/1986 | Le et al. | 347/21 |
| 5,604,521 | A * | 2/1997 | Merkel et al. | 347/47 |
| 5,912,689 | A * | 6/1999 | Otsuka et al. | 347/86 |
| 5,992,974 | A * | 11/1999 | Miyata | 347/47 |
| 6,041,600 | A | 3/2000 | Silverbrook | 60/528 |
| 6,132,028 | A | 10/2000 | Su et al. | 347/47 |
| 6,235,212 | B1 | 5/2001 | Silverbrook | 216/27 |
| 6,264,307 | B1 | 7/2001 | Silverbrook | 347/54 |
| 6,439,695 | B1 | 8/2002 | Silverbrook | 347/54 |
| 6,536,874 | B1 | 3/2003 | Silverbrook | 347/54 |
| 6,582,059 | B1 | 6/2003 | Silverbrook | 347/54 |

FOREIGN PATENT DOCUMENTS

EP 0 110 534 * 6/1884

* cited by examiner

*Primary Examiner*—Shih-Wen Hsieh
(74) *Attorney, Agent, or Firm*—Fish & Richardson P.C.

(57) ABSTRACT

A drop ejector includes a plurality of projections to control fluid flow.

31 Claims, 6 Drawing Sheets

DROP EJECTION ASSEMBLY

TECHNICAL FIELD

This invention relates to depositing drops on a substrate.

BACKGROUND

Ink jet printers are one type of apparatus for depositing drops on a substrate. Ink jet printers typically include an ink path from an ink supply to a nozzle path. The nozzle path terminates in a nozzle opening from which ink drops are ejected. Ink drop ejection is typically controlled by pressurizing ink in the ink path with an actuator, which may be, for example, a piezoelectric deflector, a thermal bubble jet generator, or an electrostatically deflected element. A typical print assembly has an array of ink paths with corresponding nozzle openings and associated actuators. Drop ejection from each nozzle opening can be independently controlled. In a drop-on-demand print assembly, each actuator is fired to selectively eject a drop at a specific pixel location of an image as the print assembly and a printing substrate are moved relative to one another. In high performance print assemblies, the nozzle openings typically have a diameter of 50 microns or less, e.g. around 25 microns, are separated at a pitch of 100–300 nozzles/inch, have a resolution of 100 to 3000 dpi or more, and provide drops with a volume of about 1 to 120 picoliters (pl) or less. Drop ejection frequency is typically 10 kHz or more.

Hoisington et al. U.S. Pat. No. 5,265,315, describes a print assembly that has a semiconductor body and a piezoelectric actuator. The body is made of silicon, which is etched to define ink chambers. Nozzle openings are defined by a separate nozzle plate, which is attached to the silicon body. The piezoelectric actuator has a layer of piezoelectric material, which changes geometry, or bends, in response to an applied voltage. The bending of the piezoelectric layer pressurizes ink in a pumping chamber located along the ink path. Piezoelectric ink jet print assemblies are also described in Fishbeck et al. U.S. Pat. No. 4,825,227, Hine U.S. Pat. No. 4,937,598, Moynihan et al. U.S. Pat. No. 5,659,346 and Hoisington U.S. Pat. No. 5,757,391, the entire contents of which are hereby incorporated by reference.

SUMMARY

In an aspect, the invention features a drop ejector that includes a flow path in which fluid is pressurized to eject drops from a nozzle opening. Adjacent the nozzle opening are a plurality of projections that extend transversely to the plane of the nozzle opening.

In another aspect, the invention features a drop ejector that includes a flow path in which fluid is pressurized for ejection through a nozzle opening. Proximate the nozzle opening, there are at least four posts extending transversely to the plane of the nozzle opening. The posts and the nozzle opening are defined in a common body.

In another aspect, the invention features fluid ejection by providing a printhead that includes a flow path in which fluid is pressurized for ejection through a nozzle opening. Proximate the nozzle opening is a plurality of projections that extend transversely to the plane of the nozzle opening. A fluid is provided that is wicked by capillary forces into the space defined by the projections.

In another aspect, the invention features a drop ejector that includes a flow path in which fluid is pressurized to eject drops from a nozzle opening. Adjacent the nozzle opening are a plurality of projections that extend transversely to the plane of the nozzle opening. The nozzle opening and projections are defined in a common body fabricated from a silicon material and the nozzle opening is disposed on a platform and the projections are disposed proximate the platform.

Other aspects or embodiments may include combinations of the features in the aspects above and/or one or more of the following. The nozzle opening is surrounded by projections. The projections are posts or they are wall-shaped. The projections are arranged in a pattern. The pattern defines an array of rows and columns or the pattern defines an arc. The pattern defines ink-collection spaces. The projections have a width that is about twice the nozzle opening width or less. The spacing between the projections and the perimeter of the nozzle opening is about 20% of the nozzle opening width or greater. The spacing between projections is about twice the nozzle width or less. The number of the projections is four or greater. The height of the projections is substantially equal to the plane of the nozzle opening or the height of the projections are below the plane of nozzle opening.

The nozzle opening and projections are defined defined in a common body and the body is a silicon material. The drop ejector includes a channel proximate the projections. The drop ejector includes a vacuum source or wicking material proximate the projections. The nozzle opening is be disposed in a well and the well includes projections. The nozzle opening is be disposed on a platform and the projections are disposed proximate the platform. The nozzle opening is 200 micron or less. The drop ejector includes a piezoelectric actuator.

Embodiments may include one or more of the following advantages. Printhead operation is robust and reliable since waste ink about the face of the nozzle plate is controlled to reduce interference with drop formation and ejection. Drop velocity and trajectory straightness is maintained in high performance printheads in which large arrays of small nozzles must accurately eject ink to precise locations on a substrate. The projections control waste ink and permit desirable jetting characteristics with a variety of jetting fluids, such as inks with varying viscosity or surface tension characteristics, and heads with varying pressure characteristics at the nozzle openings. The projections are robust, do not require moving components, and can be economically implemented by etching, e.g., in a semiconductor material such as a silicon material.

Still further aspects, features, and advantages follow. For example, particular aspects include projection dimensions, characteristics, and operating conditions described below.

DETAILED DESCRIPTION

Figure 1:
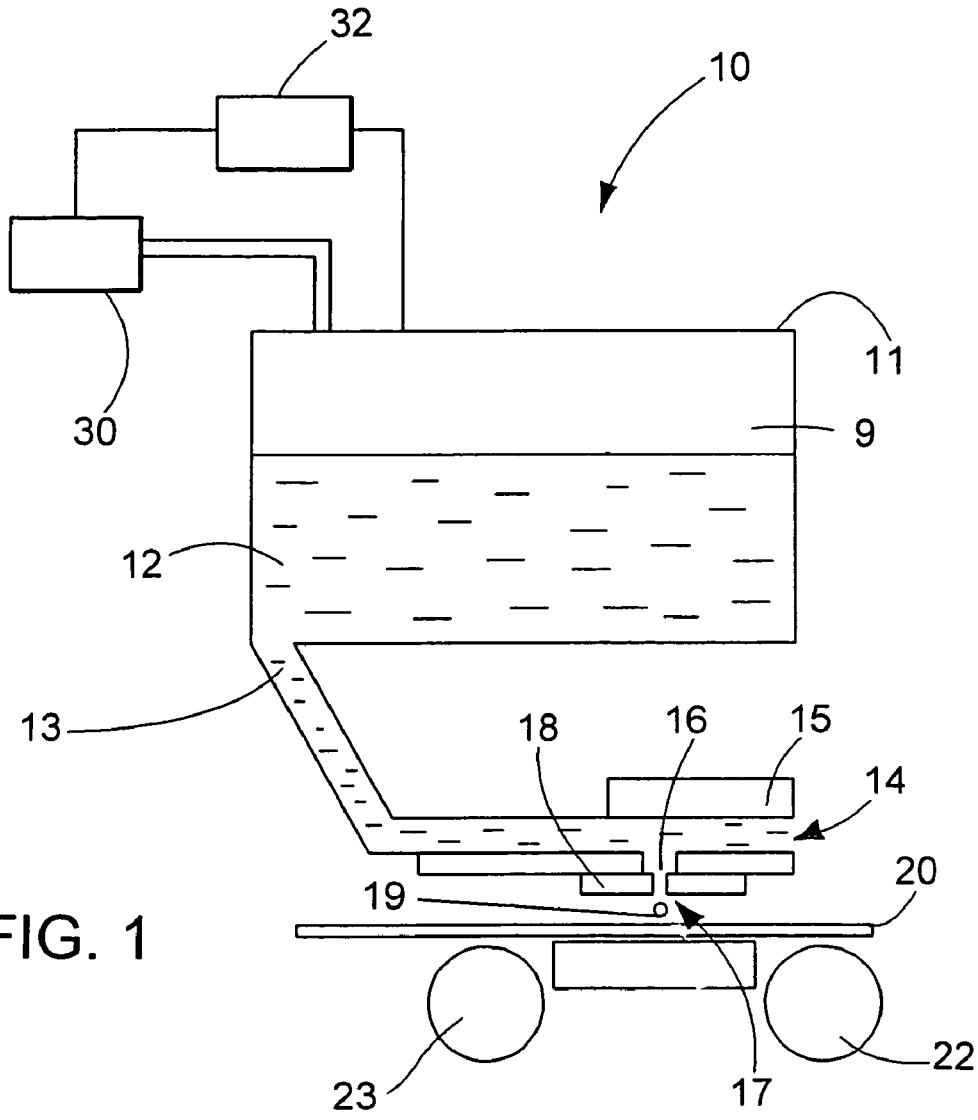
FIG. 1 is a schematic of a drop ejection assembly.

Referring to FIG. 1, an inkjet apparatus 10 includes a reservoir 11 containing a supply of ink 12 and a passage 13 leading from the reservoir 11 to a pressure chamber 14. An actuator 15, e.g., a piezoelectric transducer, forms one wall of the pressure chamber 14. The actuator is operable to force ink from the pressure chamber 14 through a passage 16 leading to a nozzle opening 17 in an nozzle plate 18, causing a drop of ink 19 to be ejected from the nozzle 17 toward a substrate 20. During operation, the ink jet apparatus 10 and the substrate 20 can be moved relative to one another. For example, the substrate can be a continuous web that is moved between rolls 22 and 23. By selective ejection of drops from an array of nozzles 17 in nozzle plate 18, a desired image is produced on substrate 20.

The inkjet apparatus also controls the operating pressure at the ink meniscus proximate the nozzle openings when the system is not ejecting drops. Variations in meniscus pressure can cause variation in drop volume or velocity which can lead to printing errors and weeping. In the embodiment illustrated, pressure control is provided by a vacuum source 30 such as a mechanical pump that applies a vacuum to the headspace 9 over the ink 12 in the reservoir 11. The vacuum is communicated through the ink to the nozzle opening 17 to prevent ink from weeping through the nozzle opening by force of gravity. A controller 32, e.g. a computer controller, monitors the vacuum over the ink in the reservoir 11 and adjusts the source 30 to maintain a desired vacuum in the reservoir. In other embodiments, a vacuum source is provided by arranging the ink reservoir below the nozzle openings to create a vacuum proximate the nozzle openings. An ink level monitor (not shown) detects the level of ink, which falls as ink is consumed during a printing operation and thus increases the vacuum at the nozzles. A controller monitors the ink level and refills the reservoir from a bulk container when ink falls below a desired level to maintain vacuum within a desired operation range. In other embodiments, in which the reservoir is located far enough below the nozzles that the vacuum of the meniscus overcomes the capillary force in the nozzle, the ink can be pressurized to maintain a meniscus proximate the nozzle openings. In embodiments, the operating vacuum is maintained at about 0.5 to about 10 inches of water.

Figure 2:
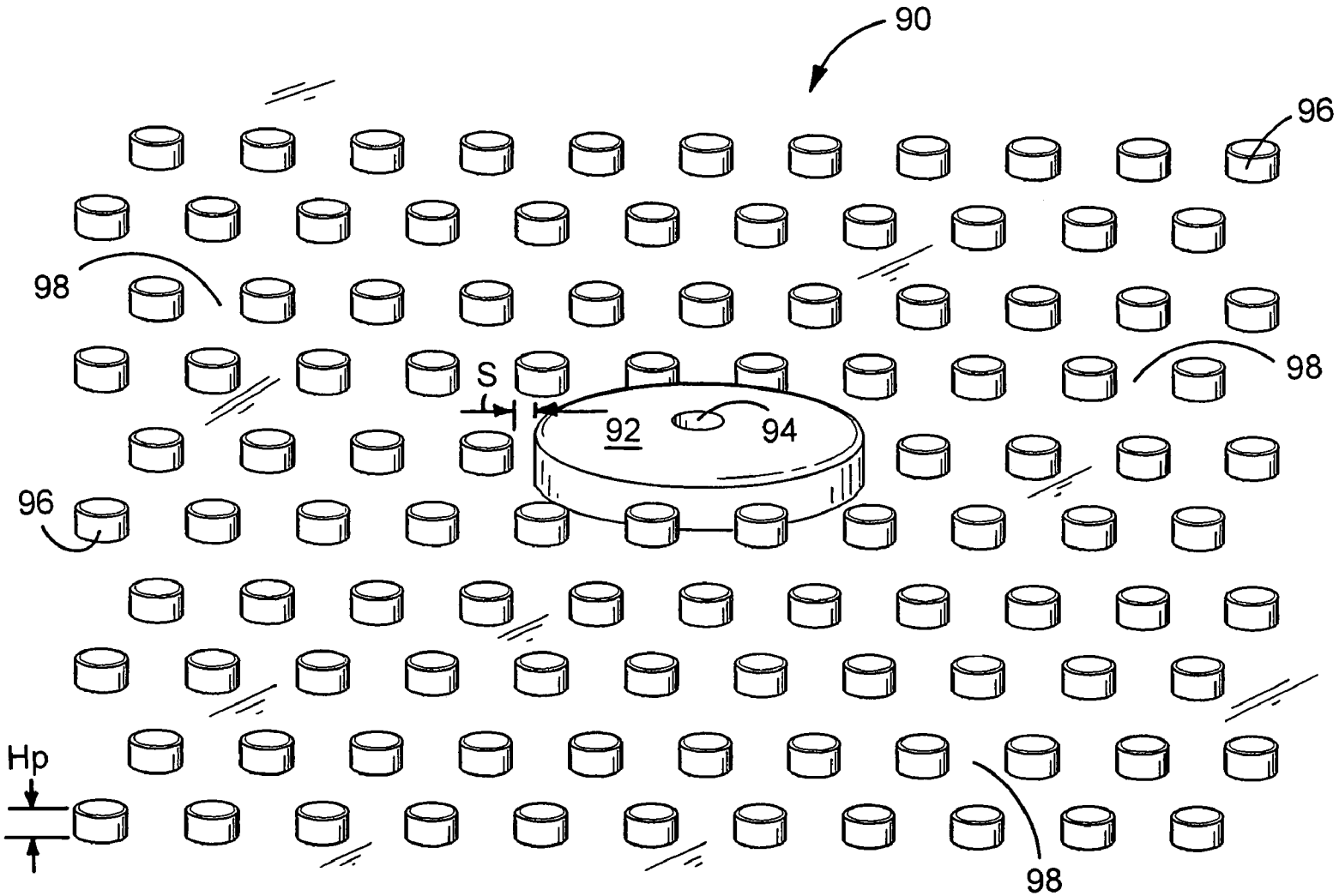
FIG. 2 is a perspective view of a portion of a nozzle plate with projections.

Referring to FIG. 2, nozzle plate portion 90 includes elevated platform 92 and nozzle opening 94 that is centered on platform 92. Proximate the platform 92 and nozzle opening 94 is a field of ink control projections 96 in the form of cylindrical posts that extend from the floor of the nozzle plate transversely to the plane of nozzle opening 94. During ink jetting, ink may collect on the nozzle plate 18. If ink collection is uncontrolled, over time, the ink can form puddles which cause printing errors. For example, puddles near the edge of a nozzle opening can affect the trajectory, velocity or volume of the ejected drops. Also, a puddle could become large enough so that it drips onto printing substrate causing an extraneous mark. The puddle could also protrude far enough off the nozzle plate surfaces that the printing substrate comes into contact with it, causing a smear on the printing substrate. The projections 96 spread waste fluid about the nozzle plate and, thus, discourage the growth of deep puddles that can, e.g., drip off the nozzle plate onto printing substrate. Initially, puddles form on platform 92 and then move from platform 92 to the field of projections 96 that are proximate platform 92. The projections 96 define spaces 98 so that waste fluid is wicked away from nozzle opening 94 by capillary forces.

Figure 3:
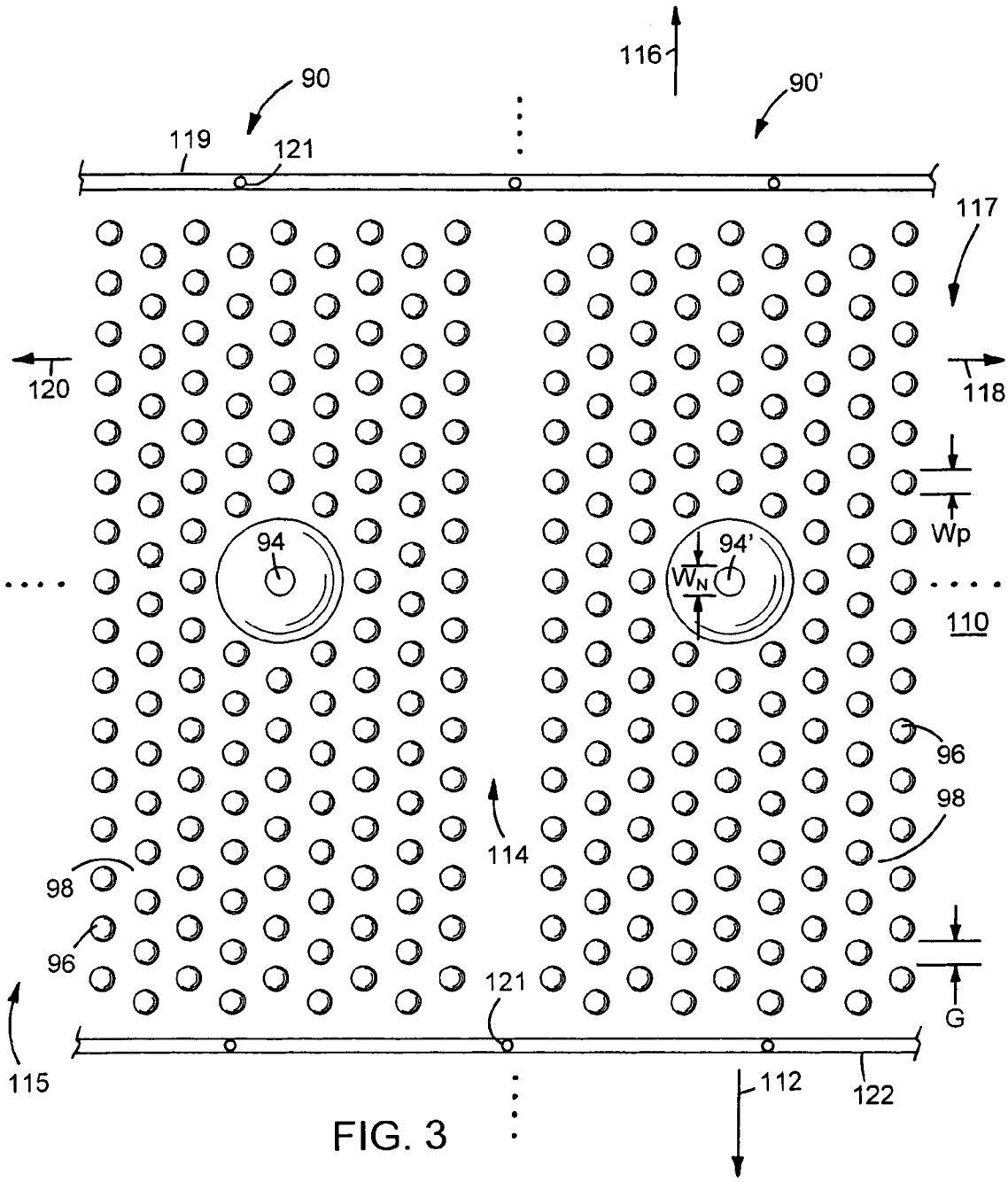
FIG. 3 is a top view of a portion of a nozzle plate with projections.

Referring to FIG. 3, two portions 90, 90' of a nozzle plate include two adjacent nozzle openings 94, 94' as illustrated. Each of the portions 90, 90' includes a field of projections surrounding the nozzle opening. The fields are bordered by void regions 114, 115 and 117 and waste channels 119, 122. Channels 119, 122 include drain apertures 121. The pattern of the projections diverts ink away from the nozzles and toward the channels. When the nozzle plate is oriented horizontally (nozzle opening upward or downward), waste ink puddles initially move in all possible directions from projection-to-projection under the influence of capillary action, including the four general directions 112, 116, 118 and 120. Once waste ink reaches void region 114, 115 or 117, movement of waste ink is retarded in that direction since the spacing between projections 96 is too great for capillary forces to continue to move waste ink in that direction. The movement of waste ink continues until encountering channels 119,122, which catch waste ink. In embodiments, apertures 121 are maintained under reduced pressure, e.g., by communication with a mechanical vacuum apparatus (not shown) to draw the waste ink from each channel. Alternatively, the apertures can be filled with a wicking material, e.g., a foamed polyurethane or other absorbent material, to remove waste ink from each channel 119. In embodiments, the ratio of the projection height to projection width is from about 0.2 to about 1 or greater, e.g. about 5 or greater. When the nozzle plate is oriented vertically, waste ink moves from projection-to-projection under the influence of gravity and capillary action, macroscopically in a single direction 112, 116, 118 or 120, depending upon the orientation of nozzle plate 110. Suitable channels are described in U.S. Ser. No. 10/749,833, filed Dec. 30, 2003, now U.S. Published Patent Application No. 20050140747, and suitable apertures are described in U.S. Ser. No. 10/749,829, filed Dec. 30, 2003, now U.S. Published Patent Application No. 20050146569, the entire disclosure of each is hereby incorporated by reference herein.

The spacing, size, location, shape, number and pattern of the projections are selected to prevent excessive pooling of ink on the nozzle surface by increasing the surface area of the nozzle plate in the area about the nozzle opening. The size of the spaces G between the projections is such that the fluid will be drawn into the openings and retained by capillary forces. In embodiments, the spacing G is between about 20% of the nozzle opening width $W_N$ or more and about twice the nozzle opening width $W_N$ or less. In embodiments, the pattern of projections define a series of rows and columns. In embodiments, the pattern defines an arc. The pattern of projections can be arranged to direct waste ink in a desired direction on the nozzle plate.

The width of the projections $W_P$ is small enough to provide substantial increase in surface area, but large enough to be sufficiently robust. In addition, the width of the projections is not so large that excessive waste ink builds up on outer surfaces. In embodiments, the width of the projections is about twice the nozzle opening width or less. The height of the projections $H_P$ can be greater than, equal to, or less than the plane of the nozzle opening. Longer projections can retain a greater amount of waste ink because they present greater surface area. Projections that are recessed below the nozzle opening plane are less susceptible to damage. Projections that are in the plane of the nozzle opening can, in some cases, be easier to manufacture, e.g., by etching.

The projections are disposed in locations on the nozzle plate in which waste ink may collect. In embodiments, the projections substantially surround the nozzle opening. In embodiments, the projections are spaced from the nozzle opening to discourage the collection of waste ink too close to the nozzle opening, where it could affect drop ejection. In embodiments, the projections are no closer to the periphery of the nozzle opening than about 20% or 200% of the nozzle opening width $W_N$.

In embodiments, the shape of the projections can be elongated posts. The posts can be, e.g., circular in cross-section or irregular in cross-section. The posts can be substantially perpendicular to the plane of the nozzle opening or at other transverse angles with respect to the plane of the nozzle opening. In other embodiments, the projections are wall structures. The wall structures can be attached to the nozzle plate over a substantial area and, thus, resist dislodgement should the nozzle plate come into contact with a foreign body, e.g., a substrate.

The number of posts is selected to control a desired jetting fluid volume or to create a desired pattern, as discussed above. In embodiments in which the projections surround the nozzle opening, there are four or more posts, e.g., six or more.

In particular embodiments, the height $H_P$ of the projections is, e.g., from about 5 microns to about 100 microns or more, for example, 200 microns. The spacing S from the closest post to the edge of platform is, e.g., from about 10 microns to about 20 microns, while the gap, G, between the projections is, e.g., about 5 microns to about 25 microns. The width of the projections $W_P$ is, e.g., from about 5 microns to about 20 microns. In embodiments, the nozzle width is about 200 microns or less, e.g., 10 to 50 microns, the nozzle pitch is about 25 nozzles/inch or more, e.g., about 100–300 nozzles/inch, the ink drop volume is about 1 to 70 pL and the fluid is pressurized by a piezoelectric actuator In embodiments, the jetting fluid has a viscosity of about 1 to 40 centipoise. In embodiments, the the fluid has a surface tension of about 20–50 dynes/cm. In embodiments, the jetting fluid is ink. In embodiments, the jetting fluid is a biological fluid.

Figure 4:
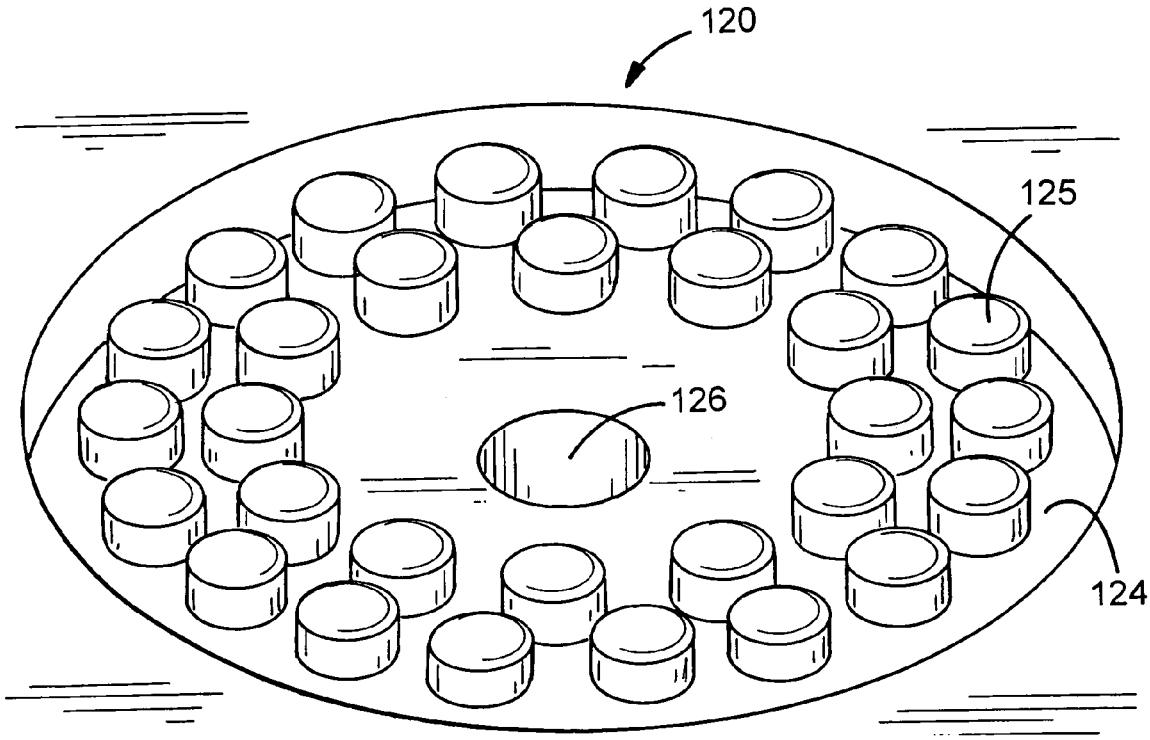
FIG. 4 is a perspective view of a portion of a nozzle plate with a nozzle opening and projections disposed in a well.

Referring now to FIG. 4, nozzle plate portion 120 includes a nozzle opening 126 disposed in a well 124 and is surrounded by projections 125 in the form of cylindrical posts proximate nozzle opening 126. Projections 125 to symmetrically spread waste ink within the well. Over time, well 124 partially fills with jetting fluid to form a meniscus over the nozzle opening. The use of a well to facilitate the jetting of fluids is described in an application entitled "DROP EJECTION ASSEMBLY" filed concurrently herewith and assigned U.S. Ser. No. 10/749,622, now U.S. Published Patent Application No. 20050146560, the disclosure of which is hereby incorporated in full by reference.

Figure 5:
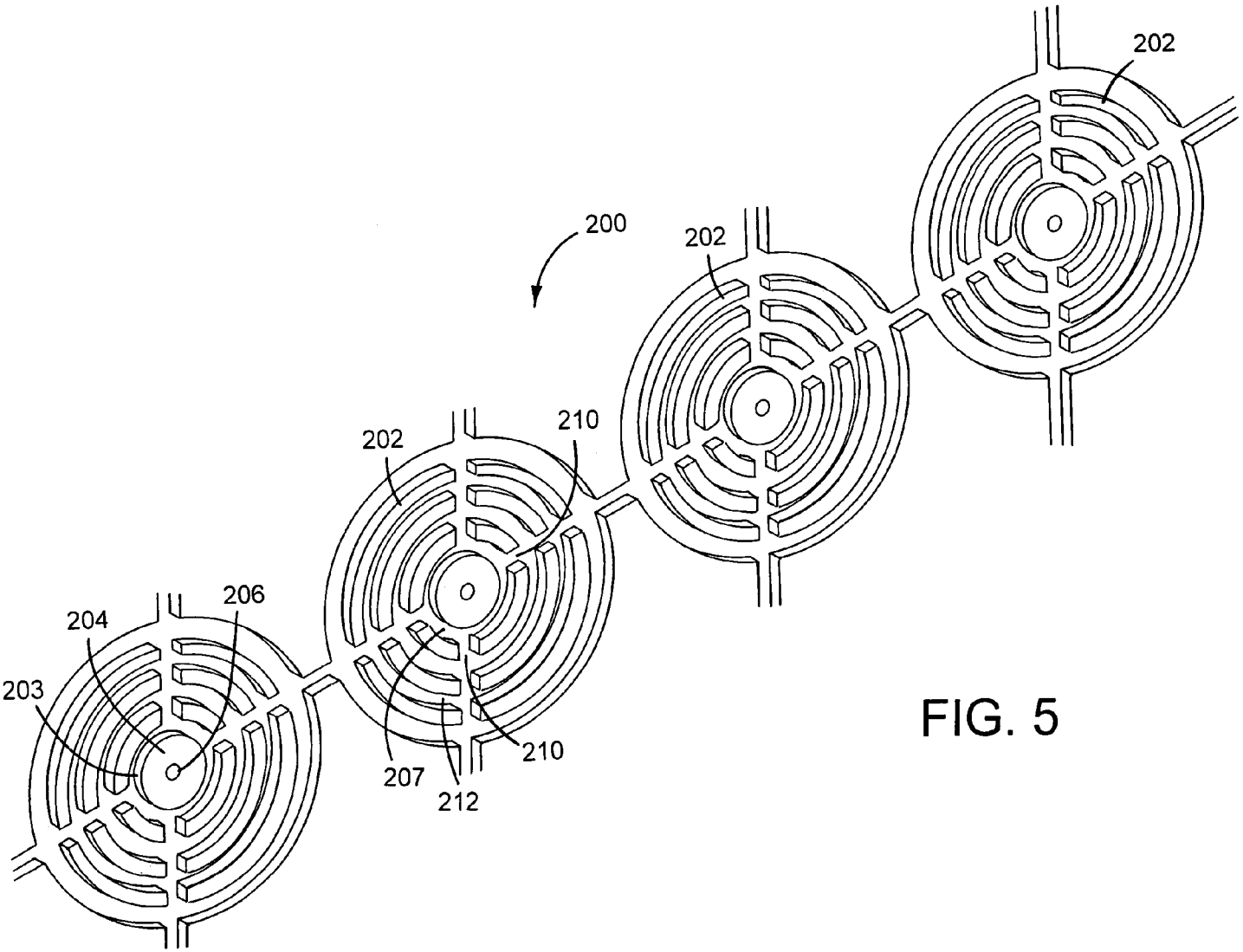
FIG. 5 is a perspective view of a portion of a nozzle plate with arcuate projections.
Figure 5A:
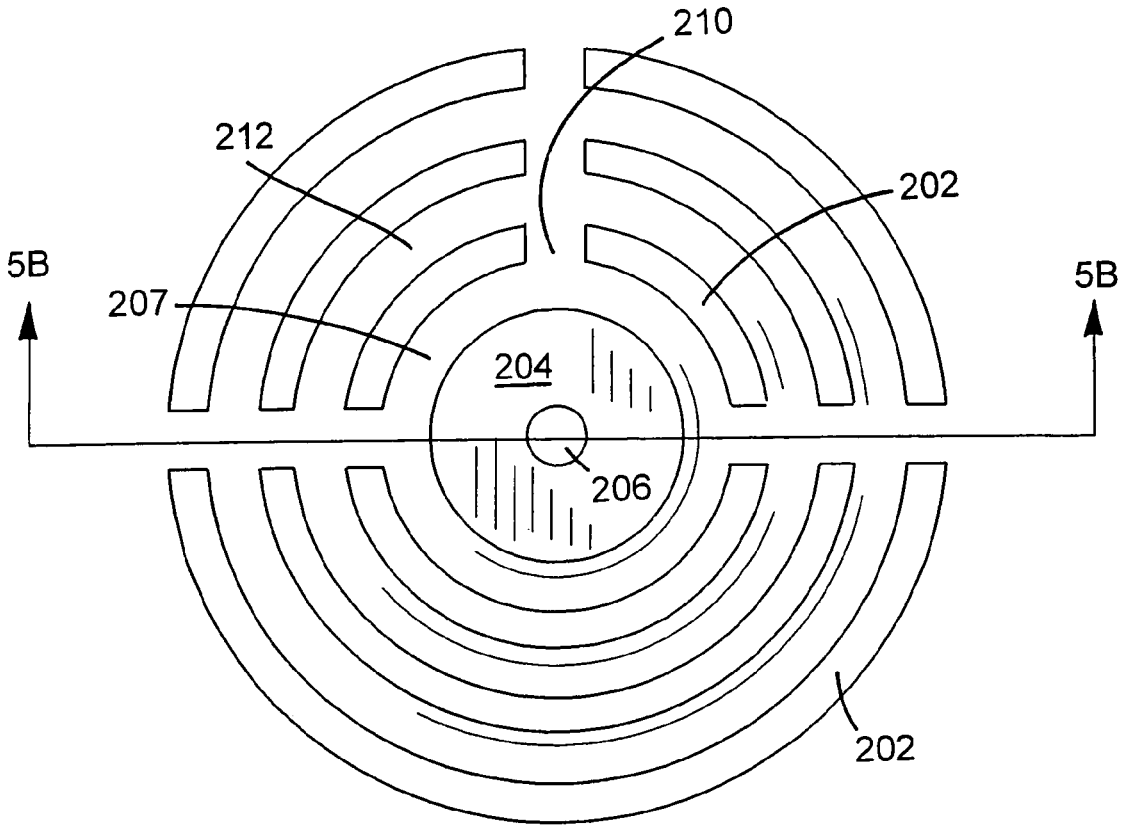
FIG. 5A is a top view of a portion of the nozzle plate shown in FIG. 5.
Figure 5B:
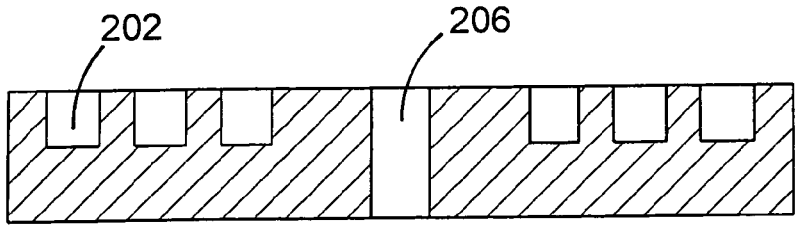
FIG. 5B is a cross-sectional view of the nozzle plate portion shown in FIG. 5A, taken along line 5B—5B.

Referring to FIGS. 5–5B, nozzle plate portion 200 includes a plurality of arcuate projections 202 in the form of walls that form broken, concentric surfaces about elevated platform 204 and nozzle opening 206 that is centered on platform 204. The projections 202 about the elevated platform 204 extend transversely to the plane of the nozzle opening 206. A first space 207 is formed between the edge of the elevated platform 203 and the first series of arcuate projections 202 that form the first broken concentric surface about the elevated platform. A second space 210 is formed between projections 202 that are radially equidistant from the center of the nozzle opening 206 and a third space 212 is formed between projections 202 on adjacent, broken concentric surfaces. Ink puddles that form on platform 204 move to the field of projections 202. The ink wicks into the first space 207 and then moves under capillary action until it finds a second space 210, and then begins to move radially away from the platform 204. Upon encountering a third space 212, the waste ink moves into that space or continues to move radially away from nozzle opening 206. The path followed by the waste ink depends upon the relative sizes of the first 207, second 210 and third 212 spaces. In embodiments, the number of broken, concentric surfaces about platform 204 is, e.g., 2, 4, 6, 10 or more. The spacing between projections is such that fluid will be drawn into the openings and retained by capillary forces as described above. In implementations, the arcuate projections are above the plane of nozzle opening 206.

The projections and/or the nozzle opening in any of the above described embodiments can be formed by machining, electroforming, laser ablation, and chemical or plasma etching. The projections can also be formed by molding, e.g., injection molded plastic projections. The projections and nozzle opening can be formed in a common body or in separate bodies that are assembled. For example, the nozzle opening can be formed in a body that defines other components of an ink flow path and the well can be formed in a separate body which is assembled to the body defining the nozzle opening. In other embodiments, the projections, nozzle opening, and pressure chamber are formed in a common body. The body can be a metal, carbon or an etchable material such as silicon material, e.g., silicon or silicon dioxide. Forming printhead components using etching techniques is further described in U.S. Ser. No. 10/189,947, filed Jul. 3, 2002, and U.S. Ser. No. 60/510,459, filed Oct. 10, 2003, the entire contents of each is hereby incorporated by reference.

In embodiments, the drop ejection system can be utilized to eject fluids other than ink. The deposited droplets can be ink or other materials. For example, the deposited droplets may be a UV or other radiation curable material or other material, for example, biological fluids, capable of being delivered as droplets. For example, the apparatus described could be part of a precision dispensing system. The projections can be formed of a porous material, e.g., porous silicon or porous metal, to increase the surface area and, thus, the waste ink handling capacity of the projections. The projections can be formed of an absorbent material that can help to wick away the waste ink from the nozzle plate.

The projections can be used in combination with other waste fluid control features such as apertures described in U.S. Ser. No. 10/749,829, filed Dec. 30, 2003, now U.S. Published Patent Application No. 20050146569, wells as described in U.S. Ser. No. 10/749,622, filed Dec. 30, 2003, now U.S. Published Patent Application No. 20050146560 and/or channels as described in U.S. Ser. No. 10/749,833, filed Dec. 30, 2003, now U.S. Published Patent Application No. 20050140747. For example, a series of channels can be included on the nozzle face proximate the projections. The cleaning structures can be combined with a manual or automatic washing and wiping system in which a cleaning fluid is applied to the nozzle plate and wiped clean. The cleaning structures can collect cleaning fluid and debris rather than jetted waste ink.

Still other embodiments are within the scope of the following claims.

What is claimed is:

1. A drop ejector, comprising: a flow path in which fluid is pressurized to eject drops from a nozzle opening in a plane, and proximate the nozzle opening, a plurality of projections, wherein the height of the projections is substantially equal to the plane of the nozzle opening.

2. The drop ejector of claim 1 wherein the nozzle opening is surrounded by projections.

3. The drop ejector of claim 1 wherein the projections are posts.

4. The drop ejector of claim 1 wherein the projections are wall-shaped.

5. The drop ejector of claim 1 wherein the projections are arranged in a pattern.

6. The drop ejector of claim 5 wherein the pattern defines an array of rows and columns.

7. The drop ejector of claim 5 wherein the pattern defines an arc.

8. The drop ejector of claim 5, wherein the pattern defines concentric ink-collection spaces.

9. The drop ejector of claim 1 wherein the projections have a width that is about twice the nozzle opening width or less.

10. The drop ejector of claim 1 further comprising the nozzle opening having a perimeter and a nozzle opening width, wherein the projections are no closer to the perimeter of the nozzle opening than about 20% of the nozzle opening width.

11. The drop ejector of claim 1 wherein the spacing between projections is about twice the nozzle width or less.

12. The drop ejector of claim 1 wherein the number of the projections is four or greater.

13. The drop ejector of claim 1 wherein the nozzle opening is disposed in a well and the well includes said projections.

14. The drop ejector of claim 1 wherein the spacing between said projections is about 10% of the nozzle opening width or greater and twice the nozzle opening width or less.

15. The drop ejector of claim 1 wherein the nozzle opening and projections are defined in a common body.

16. The drop ejector of claim 15 wherein the body is a silicon material.

17. The drop ejector of claim 1 including a channel proximate the projections.

18. A drop ejector, comprising: a flow path in which fluid is pressurized to eject drops from a nozzle opening in a plane, and proximate the nozzle opening, a plurality of projections, wherein the height of the projections is below the plane of nozzle opening.

19. The drop ejector of claim 18 wherein the nozzle opening and projections are defined in a common body.

20. The drop ejector of claim 19 wherein the body is a silicon material.

21. The drop ejector of claim 18 including a channel proximate the projections.

22. The drop ejector of claim 18 including a vacuum source or wicking material proximate the projections.

23. The drop ejector of claim 18 wherein the nozzle opening is disposed in a well and the well includes said projections.

24. The drop ejector of claim 18 wherein the nozzle opening is disposed on a platform and the projections are disposed proximate the platform.

25. The drop ejector of claim 18 including a plurality of nozzle openings and a plurality of projections proximate each of the nozzle openings, said nozzle openings and said projections defined in a common body.

26. The drop ejector of claim 18 wherein the nozzle opening width is about 200 micron or less.

27. The drop ejector of claim 18 including a piezoelectric actuator.

28. The drop ejector of claim 18 wherein the spacing between said projections is about 10% of the nozzle opening width or greater and twice the nozzle opening width or less.

29. The drop ejector of claim 18 wherein the projections have a width that is about twice the nozzle opening or less.

30. The drop ejector of claim 18 wherein the projections are arranged in a pattern.

31. The drop ejector of claim 30, wherein the pattern defines concentric ink-collection spaces.

* * * * *